US009018934B2

(12) United States Patent
Chang et al.

(10) Patent No.: US 9,018,934 B2
(45) Date of Patent: Apr. 28, 2015

(54) LOW VOLTAGE BANDGAP REFERENCE CIRCUIT

(71) Applicant: Integrated Circuit Solution Inc., Hsin-Chu (TW)

(72) Inventors: Ching-Hung Chang, Hsin-Chu (TW); Chun-Lung Kuo, Hsin-Chu (TW); Ching-Tang Wu, Hsin-Chu (TW); Chung-Cheng Wu, Hsin-Chu (TW); Chung-Hao Chen, Hsin-Chu (TW)

(73) Assignee: Integrated Circuit Solution Inc., Hsin-Chu (TW)

( * ) Notice: Subject to any disclaimer, the term of this patent is extended or adjusted under 35 U.S.C. 154(b) by 121 days.

(21) Appl. No.: 13/847,570

(22) Filed: Mar. 20, 2013

(65) Prior Publication Data

US 2014/0176112 A1 Jun. 26, 2014

(30) Foreign Application Priority Data

Dec. 20, 2012 (TW) ..... 101148711 A

(51) Int. Cl.
*G05F 3/16* (2006.01)
*G05F 3/30* (2006.01)

(52) U.S. Cl.
CPC ..... *G05F 3/30* (2013.01)

(58) Field of Classification Search
USPC ..... 323/311–317
See application file for complete search history.

(56) References Cited

U.S. PATENT DOCUMENTS

| | | | | |
|---|---|---|---|---|
| 8,581,568 | B2 * | 11/2013 | Liang et al. | 323/313 |
| 2006/0108994 | A1 * | 5/2006 | Neaves | 323/317 |
| 2013/0169259 | A1 * | 7/2013 | Saxena et al. | 323/313 |

* cited by examiner

*Primary Examiner* — Adolf Berhane
*Assistant Examiner* — Henry Lee, III
(74) *Attorney, Agent, or Firm* — Lin & Associates IP, Inc.

(57) ABSTRACT

A low voltage bandgap reference circuit includes a positive temperature coefficient circuit unit, a negative temperature coefficient circuit unit and a load unit, wherein the positive temperature coefficient circuit unit comprises a first differential operational amplifier, a first, second and third transistor, a first resistor, a first and second diode, and the negative temperature coefficient circuit unit includes a second differential operational amplifier, a fourth, fifth and sixth transistor, a second resistor and a third diode. The low voltage bandgap reference circuit provides a current having a positive temperature coefficient characteristics and a current having a negative temperature coefficient characteristics to flow through the load in order to generate a stable reference voltage less affected by the temperature. Therefore, it avoids the problems of the low voltage bandgap reference circuit that can not be activated at low voltage.

10 Claims, 6 Drawing Sheets

LOW VOLTAGE BANDGAP REFERENCE CIRCUIT

BACKGROUND OF THE INVENTION

1. Field of the Invention

The present invention generally relates to a bandgap reference circuit, which can successfully operate with a low supply-voltage below 1.25V, and more specifically to a bandgap reference circuit having a single stable operating point to avoid startup failure.

2. The Prior Arts

General high performance electronic circuits greatly need a stable reference voltage without suffering from different variations caused by the power source, loading level or operating temperature. For example, the reference voltage can be used as an input signal of a comparator to compare with another internal or external signal. The reference voltage is often generated by a reference circuit with complicated structure so as to block all the inevitable variations due to the power source, loading or temperature.

In the prior arts, electronic manufacturers have successfully developed many reference circuits which can prevent the influence caused by the power source and loading level. Additionally, the variation of the temperature is blocked by using a differential operational amplifier as well as resistors and diodes to assemble a specific circuit having both the positive and negative temperature coefficients, and in particular, the positive and negative temperature coefficients are signed to almost the same in the magnitude such that the temperature effect is greatly reduced. Specifically, the first and second orders of the temperature coefficient for the reference circuit are almost zero.

Please refer to FIG. 1. The bandgap reference circuit in the prior arts comprises a differential operational amplifier OP, a metal-oxide-semiconductor (MOS) P, a first resistor R1, a second resistor R2, a third resistor R3, a first diode D1 and a second diode D2. The reference voltage Vref is generated at the drain terminal of the MOS P, and the second diode D2 is implemented by several diodes connected in parallel and each identical to the first diode D1 in electrical property.

More specifically, the bandgap reference circuit is configured such that the output end of the differential operational amplifier OP is connected to the gate terminal of the MOS P, the source terminal of the MOS P is connected to the power source Vcc, the first resistor R1 is connected between the drain terminal of the MOS P and the positive end of the first diode D1, and the second resistor R2 and the third resistor R3 are connected in series between the drain terminal of the MOS P and the positive end of the second diode D2. Particularly, the positive end of the first diode D1 is further connected to the inverting input end of the differential operational amplifier OP, and the connection point of the second resistor R2 and the third resistor R3 is further connected to the non-inverting input end of the differential operational amplifier OP, thereby providing a feedback control loop.

The detailed operation of the bandgap reference circuit in FIG. 1 will be described as follows.

First, the current of the diode in accordance with the current-voltage characteristic is illustrated by equation (1):

$$I = Is \cdot \left(e^{\frac{q \cdot Vf}{k \cdot T}} - 1\right) \tag{1}$$

-continued $$\cong Is \cdot e^{\frac{q \cdot Vf}{k \cdot T}} \; VF >> \frac{k \cdot T}{q},$$

where q is the electrical charge per electron ($1.6\times10^{-19}$ C), K is the Boltzmann constant ($1.38\times10^{-23}$ J/K), T is the absolute temperature, Is is the reverse saturation current, and Vf is the thermal voltage (26 mV at 25° C.). The thermal voltage Vf can be expressed by equation (2):

$$Vf = V_T \cdot In\left(\frac{I}{Is}\right). \tag{2}$$

Therefore, when the differential operational amplifier OP is operated at a steady-state, the inverting input voltage Va is equal to the non-inverting input voltage Vb, that is I1·R1=I2·R2, and the first current I1 and the second current I2 flow through the first resistor R1 and the second resistor R2, respectively. Thus, the following equations are obtained from equation (2):

$$Vf1 = V_T \cdot In\left(\frac{I1}{Is}\right)$$

$$Vf2 = V_T \cdot In\left(\frac{I2}{N \cdot Is}\right)$$

and equation (3) results:

$$\begin{aligned} dVf &= Vf1 - Vf2 \\ &= V_T \cdot In\left(\frac{N \cdot I1}{I2}\right) \\ &= V_T \cdot In\left(\frac{N \cdot R2}{R1}\right). \end{aligned} \tag{3}$$

The reference voltage Vref shown in FIG. 1 can be expressed by equation (4):

$$\begin{aligned} Vref &= Vf1 + I_1 \cdot R1 \\ &= Vf1 + I_2 \cdot R2 \\ &= Vf1 + \left(\frac{dVf}{R3}\right) \cdot R2 \\ &= Vf1 + \left(\frac{R2}{R3}\right) \cdot dVf. \end{aligned} \tag{4}$$

Subsequently, equation (5) is resulted in by combining equations (3) and (4):

$$V_{ref} = V_{f1} + V_T \cdot \left(\frac{R2}{R3}\right) \cdot \ln\left(\frac{N \cdot R2}{R1}\right). \tag{5}$$

$V_{f1}$ in equation (5) is the built-in voltage, which has a negative temperature coefficient (−2.2 mV/° C.) and $V_T$ has a positive temperature coefficient (+0.085 mV/° C.). Further, equation (6) is derived by putting these parameters into equation (5):

$$Vref(T) = (V_{f10} - 2.2\times10^{-3}\cdot\Delta T) + (V_{T0} + 0.085\times10^{-3}\cdot\Delta T)\cdot\left(\frac{R2}{R3}\right)\cdot In\left(\frac{N\cdot R2}{R1}\right). \quad (6)$$

Therefore, if the temperature coefficient of Vref(T) is zero, then $$\frac{\partial Vref}{\partial T} = 0,$$

and equation (7) is thus obtained:

$$\left(\frac{R2}{R3}\right)\cdot In\left(\frac{N\cdot R2}{R1}\right) = 25.88. \quad (7)$$

At this time, $V_{f10}$ is about 0.6V, and $V_{T0}$ is about 0.026V for the temperature 25° C., and equation (8) is derived from equations (6) and (7):

$$Vref=0.6+0.026\cdot25.88=1.27 \quad (8).$$

From the above-mentioned, the bandgap reference circuit shown in FIG. 1 generates the reference voltage, 1.27V, regardless of the first, second and third resistors. That is, the reference voltage may suffer some variation due to different semiconductor processes, but not much. For example, the reference voltage Vref possibly varies between 1.17V~1.37V when $V_{f10}$ is 0.5V~0.7V.

However, one of the shortcomings of the bandgap reference circuit in the prior arts is that the bandgap reference circuit can not normally operate if the power source Vcc is less than the reference Vref, such as 1.27V, because the differential operational amplifier OP and the MOS P do not properly work.

For further illustration, please refer to another example in the prior arts as shown in FIG. 2. Similar to the structure in FIG. 1, the bandgap reference circuit in FIG. 2 generally comprises a differential operational amplifier OP, a first transistor P1, a second transistor P2, a third transistor P3, a first resistor R1, a second resistor R2, a third resistor R3, a fourth resistor R4, a first diode D1 and a second diode D2. The second diode D2 is implemented by several diodes connected in parallel and each identical to the first diode D1 in electrical property.

Specifically, the output end of the differential operational amplifier OP is connected to the gate terminals of the first transistor P1, the second transistor P2 and the third transistor P3, the source terminals of the a first transistor P1, the second transistor P2 and the third transistor P3 are connected to the power source Vcc. The positive end of the first diode D1 and one end of the first resistor R1 are connected to the drain terminal of the first transistor P1. One end of the second resistor R2 and one end of the third resistor R3 are connected to the drain terminal of the second transistor P2, the other end of the third resistor R3 is connected to the positive end of the second diode D2, and one end of the fourth resistor R4 is connected to the drain terminal of the third transistor P3. Furthermore, the other end of the first resistor R1, the negative end of the first diode D1, the negative end of the second diode D2, the other end of the second resistor R2 and the other end of the fourth resistor R4 are grounded.

Particularly, the drain terminal of the first transistor P1 is further connected to the inverting input end of the differential operational amplifier OP, and the drain terminal of the second transistor P2 is further connected to the non-inverting input end of the differential operational amplifier OP, thereby providing feedback control loop and the reference voltage Vref at the drain terminal of the third transistor P3.

Hereafter, the operation of the bandgap reference circuit in FIG. 2 will be described in detail.

Each of the transistors P1, P2 and P3 has identical electrical property such that the inverting input voltage Va is equal to the non-inverting input voltage Vb when the differential operational amplifier OP is operated at the steady state, that is, I1*a*=I2*a* and I1*b*=I2*b*, where the current I1*a* flows through the first diode D1, the current I2*a* flows through the third resistor R3, the current I1*b* flows through the first resistor R1, and the current I2*b* flows through the second resistor R2. Therefore, the following equation (9) is obtained:

$$\begin{aligned} dVf &= Vf1 - Vf2 \\ &= V_T\cdot In\left(\frac{N\cdot I1a}{I2a}\right) \\ &= V_T\cdot In(N). \end{aligned} \quad (9)$$

And, the reference voltage Vref can be expressed as equation (10):

$$\begin{aligned} Vref &= R4\cdot I3 \\ &= R4\cdot(I2b + I2a) \\ &= R4\cdot\left(\frac{Vf1}{R2} + \frac{dVf}{R3}\right) \\ &= \frac{R4}{R2}\cdot\left[Vf1 + \left(\frac{R2}{R3}\right)\cdot dVf)\right]. \end{aligned} \quad (10)$$

Moreover, equation (11) is thus derived from equations (4) and (8):

$$\left[Vf1 + \left(\frac{R2}{R3}\right)\cdot dVf)\right] = 1.27. \quad (11)$$

At this time, equation (11) is put into equation (10) to acquire the reference voltage Vref as shown by equation (12):

$$Vref = \frac{R4}{R2}\times1.27. \quad (12)$$

Therefore, the reference voltage Vref is changed by adjusting the ratio of R4/R2 such that the bandgap reference circuit can still properly function at the power source Vcc less than 1.27V.

However, the shortcoming of the above bandgap reference circuit is that if R1=R2 and Va and Vb do not attain the corresponding cut-in voltage Vth of the diodes D1 and D2, respectively, at the beginning of starting, I1*b*>>I1*a* and I2*b*>>I1*a* such that Va is almost equal to Vb, and the differential operational amplifier OP does not normally work. Thus, start failure results. Another problem is that the bandgap reference circuit has more than one stable operating point, that is, several intersection points of the inverting input voltage Va and the non-inverting input voltage Vb, as shown in FIG. 3. More specifically, the bandgap reference circuit can normally perform at the stable operating point A. But, the bandgap reference circuit fails at the multiple stable operating points B, that is, the points when the inverting input voltage Va and the non-inverting input voltage Vb are the same. This is because the bandgap reference circuit may perform at the stable operating points B before the inverting input voltage Va and the non-inverting input voltage Vb attain the corresponding cut-in voltage Vth of the diodes D1 and D2, respectively. Consequently, the whole electrical function of the bandgap reference circuit fails.

Therefore, it is greatly needed for a low voltage bandgap reference circuit, which is able to adjust the reference voltage generated and has a single stable operating point less than the power source so as to avoid the start failure at low voltage, thereby solving the above problems of the bandgap reference circuit in the prior arts.

SUMMARY OF THE INVENTION

The primary objective of the present invention is to provide a low voltage bandgap reference circuit for operating at a low voltage and providing a stable reference voltage. The low voltage bandgap reference circuit comprises a positive temperature coefficient circuit unit generating a current with a positive temperature coefficient, a negative temperature coefficient circuit unit generating a current with a negative temperature coefficient, and a load unit through which the currents flow to generate the reference voltage, so as to avoid any influence of the variation of the operating temperature by appropriately cancelling the positive and negative temperature coefficients each other.

The positive temperature coefficient circuit unit comprises a first differential operational amplifier, a first transistor, a second transistor, a third transistor, a first resistor, a first diode and a second diode. The source terminals of the first, second and third transistors are connected to a power source. The gate terminals of the first, second and third transistors are in parallel connected to an output terminal of the first differential operational amplifier. A drain terminal of the first transistor is connected to a positive end of the first diode, a drain terminal of the second transistor is connected to one end of the first resistor, and the other end of the first resistor is connected to a positive end of the second diode. The negative ends of the first and second diodes are grounded.

The drain terminal of the first transistor is further connected to an inverting input end of the first differential operational amplifier, and the drain terminal of the second transistor is further connected to a non-inverting input end of the first differential operational amplifier.

The negative temperature coefficient circuit comprises a second differential operational amplifier, a fourth transistor, a fifth transistor, a sixth transistor, a second resistor and a third diode. The source terminals of the fourth, fifth and sixth transistors are connected to the power source. The gate terminals of the fourth, fifth and sixth transistors are in parallel connected to an output terminal of the second differential operational amplifier. The drain terminal of the fourth transistor is connected to a positive end of the third diode. A negative end of the third diode is grounded, a drain terminal of the fifth transistor is connected to one end of the second resistor, and the other end of the second resistor is grounded.

The drain terminal of the fourth transistor is further connected to an inverting input end of the second differential operational amplifier, and the drain terminal of the fifth transistor is further connected to a non-inverting input end of the second differential operational amplifier.

An end of the load unit is connected to a drain terminal of the third transistor and a drain terminal of the sixth transistor. Another end of the load unit is grounded. Preferably, the load unit can be simply implemented by a resistive load.

Additionally, the second diode is implemented by a plurality of diodes connected in parallel and each electrically identical to the first diode. The third diode has electrical property identical to the first diode. Each of the first differential operational amplifier and the second differential operational amplifier has identical electrical property. Further, the first, second, third, fourth, fifth and sixth transistors have identical electrical property.

Therefore, the positive temperature coefficient circuit unit uses the drain terminal of the third transistor to provide the current with the positive temperature coefficient flowing through the load unit, and simultaneously, the negative temperature coefficient circuit unit uses the drain terminal of the sixth transistor to provide the current with the negative temperature coefficient flowing through the load unit, such that the two ends of the load unit generate the reference voltage, which is less influenced by the temperature.

Another objective of the present invention is to provide a low voltage bandgap reference circuit by replacing the above diodes with the base-emitter junction of the bipolar transistors. That is, the first and second diodes in the positive temperature coefficient circuit unit are replaced with the first and second bipolar transistors, and the third diode in the negative temperature coefficient circuit unit are replaced with the third bipolar transistor. Specifically, the base and collector terminals of the first, second and third bipolar transistors are grounded, and the emitter terminals of the first, second and third bipolar transistors are connected in the same manner the positive ends of the above-mentioned first, second and third diodes.

Moreover, the second bipolar transistor can be preferably implemented by a plurality of bipolar transistors which are connected in parallel and have electrical property identical to the first bipolar transistor. The third bipolar transistor has electrical property identical to the first bipolar transistor.

Therefore, it is possible to provide the reference voltage at the low voltage, which suffers less negative effect by the temperature. In particular, the present invention has only one stable operating point such that the operating stability of the whole electrical property is secured, thereby successfully avoiding any malfunction due to the internal operational amplifiers.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENT

The present invention may be embodied in various forms and the details of the preferred embodiments of the present invention will be described in the subsequent content with reference to the accompanying drawings. The drawings (not to scale) show and depict only the preferred embodiments of the invention and shall not be considered as limitations to the scope of the present invention. Modifications of the shape of the present invention shall too be considered to be within the spirit of the present invention.

Figure 1:
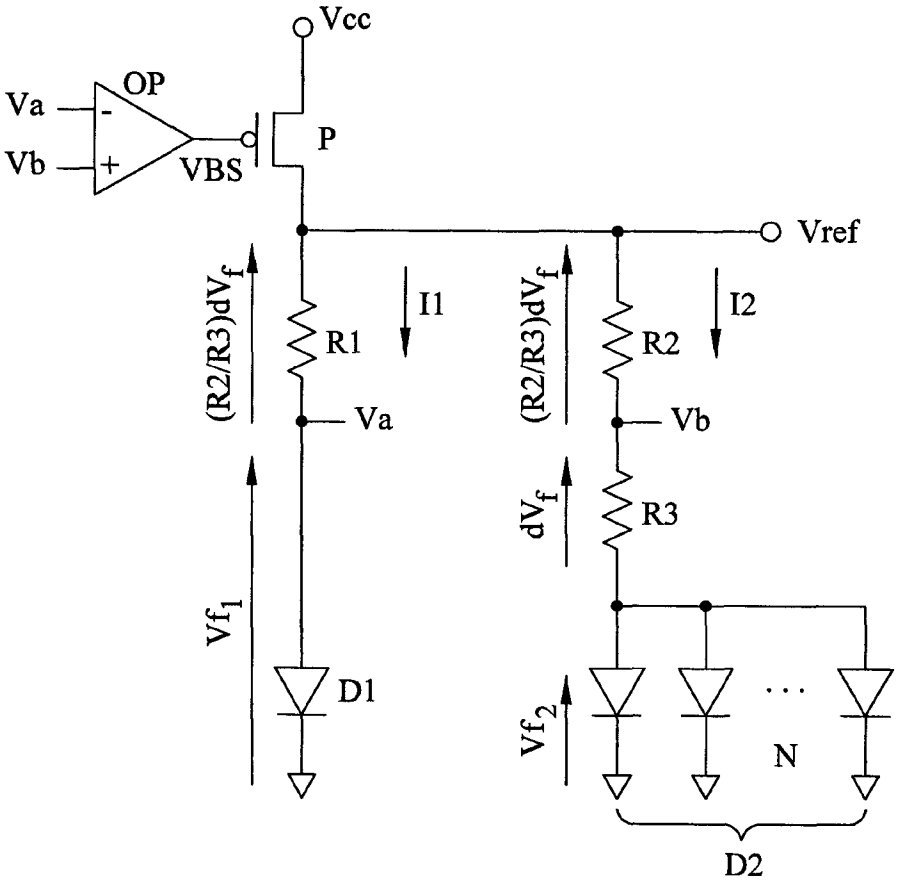
Fig. 1 (Prior Art)
FIG. 1 is a view showing one bandgap reference circuit in the prior arts.
Figure 2:
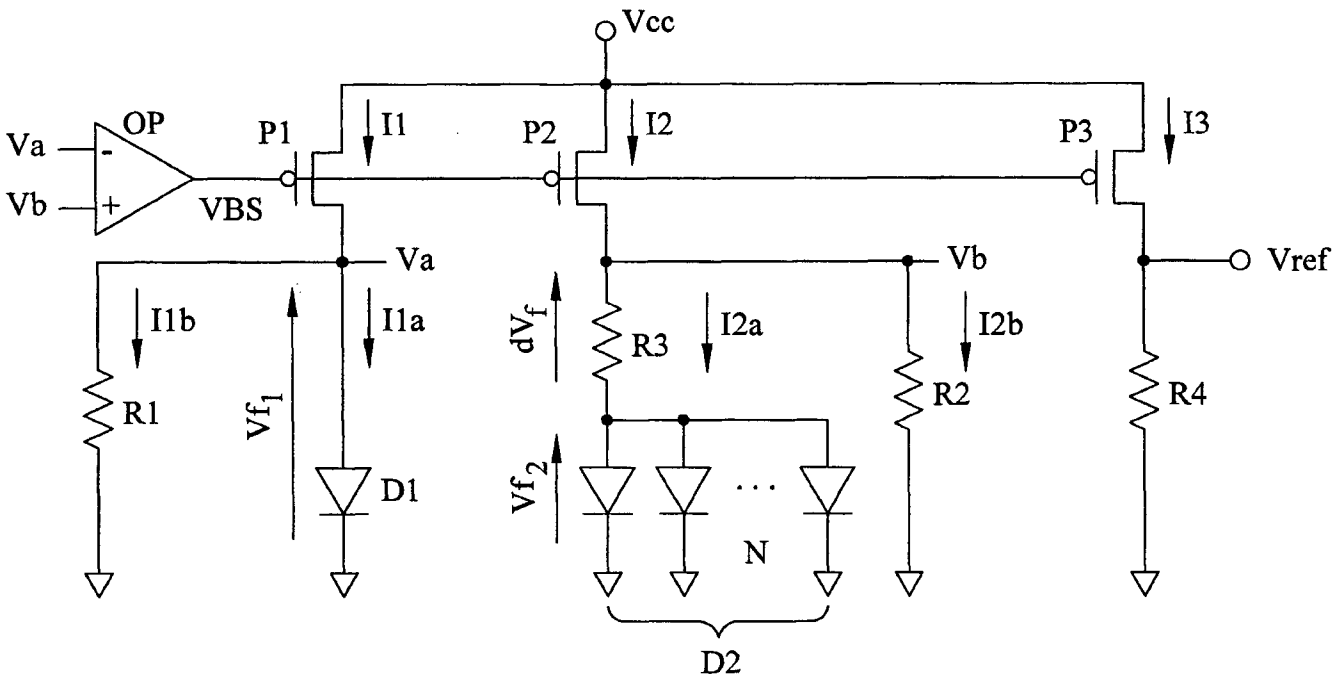
Fig. 2 (Prior Art)
FIG. 2 is a view showing another bandgap reference circuit in the prior arts.
Figure 3:
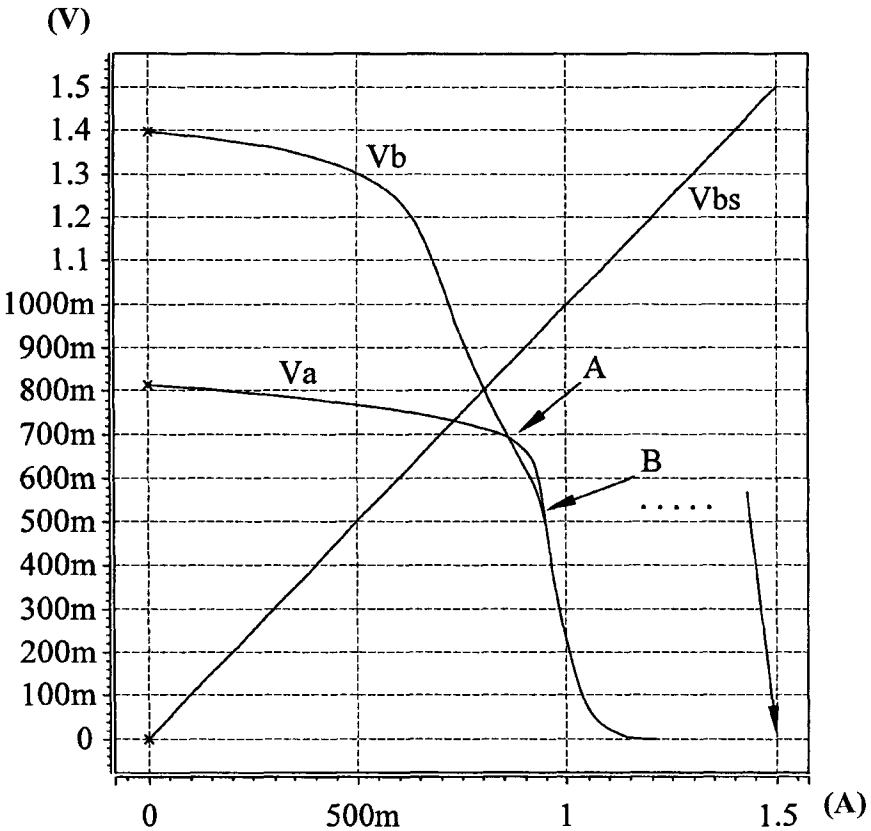
Fig. 3 (Prior Art)
FIG. 3 is a view showing the waveform of the bandgap reference circuit in the prior arts.
Figure 4:
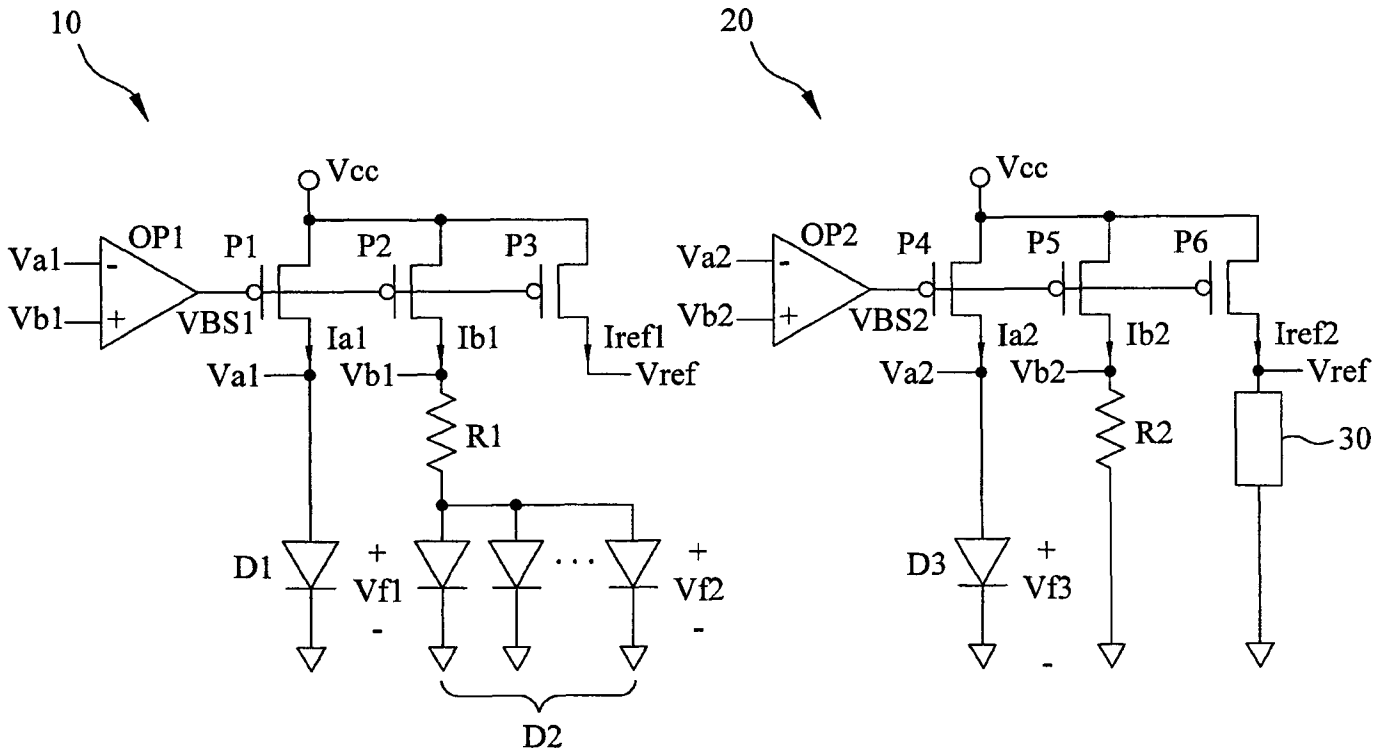
FIG. 4 shows the first embodiment of the low voltage bandgap reference circuit according to the present invention.

Please refer to FIG. 4. As shown in FIG. 4, the low voltage bandgap reference circuit according to the first embodiment of the present invention comprises a positive temperature coefficient circuit unit 10, a negative temperature coefficient circuit unit 20 and a load unit 30 to provide a stable reference voltage Vref at the power source Vcc with a low voltage. The positive temperature coefficient circuit unit 10 provides a positive temperature coefficient current Iref1 with the positive temperature coefficient, the negative temperature coefficient circuit unit 20 provides a negative temperature coefficient current Iref2 with the negative temperature coefficient, and the positive and negative temperature coefficient currents Iref1 and Iref2 are combined and flow through the load unit 30. Specifically, the positive and negative temperature coefficients are well designed to cancel each other, and the reference voltage Vref generated at the two ends of the load unit 30 has the net temperature coefficient of zero or almost zero.

More specifically, the positive temperature coefficient circuit unit 10 may comprise a first differential operational amplifier OP1, a first transistor P1, a second transistor P2, a third transistor P3, a first resistor R1, a first diode D1 and a second diode D2. The positive temperature coefficient current Iref1 is generated by the positive temperature coefficient circuit unit 10. The source terminals of the first, second and third transistors P1~P3 are connected to a power source Vcc. The gate terminals of the first, second and third transistors P1~P3 are in parallel connected to an output terminal of the first differential operational amplifier OP1. A drain terminal of the first transistor P1 is connected to a positive end of the first diode D1, a drain terminal of the second transistor P2 is connected to one end of the first resistor R1, and the other end of the first resistor R1 is connected to a positive end of the second diode D2. The negative ends of the first and second diodes D1 and D2 are grounded.

Furthermore, the drain terminal of the first transistor P1 is connected to an inverting input end of the first differential operational amplifier OP1 as a first inverting input voltage Va1, and the drain terminal of the second transistor P2 is connected to a non-inverting input end of the first differential operational amplifier OP1 as a first non-inverting input voltage Vb1.

The negative temperature coefficient circuit 20 may comprise a second differential operational amplifier OP2, a fourth transistor P4, a fifth transistor P5, a sixth transistor P6, a second resistor R2 and a third diode D3. The negative temperature coefficient circuit 20 generates a negative temperature coefficient current Iref2. The source terminals of the fourth, fifth and sixth transistors P4~P6 are connected to the power source Vcc. The gate terminals of the fourth, fifth and sixth transistors P4~P6 are in parallel connected to an output terminal of the second differential operational amplifier OP2. The drain terminal of the fourth transistor P4 is connected to a positive end of the third diode D3. A negative end of the third diode D3 is grounded, a drain terminal of the fifth transistor P5 is connected to one end of the second resistor R2, and the other end of the second resistor R2 is grounded. The drain terminal of the fourth transistor P4 is further connected to an inverting input end of the second differential operational amplifier OP2 as a second inverting input voltage Va2, and the drain terminal of the fifth transistor P5 is further connected to a non-inverting input end of the second differential operational amplifier OP2 as a second non-inverting input voltage Vb2.

One end of the load unit 30 is connected to a drain terminal of the third transistor P3 and a drain terminal of the sixth transistor R6. The other end of the load unit 30 is grounded. Specifically, the load unit 30 can be simply implemented by a resistive load.

Preferably, the second diode D2 is implemented by a plurality of diodes connected in parallel and each electrically identical to the first diode D1, and the third diode D3 has electrical property identical to the first diode D1. Each of the first second differential operational amplifiers OP1 and OP2 has identical electrical property. Further, the first, second, third, fourth, fifth and sixth transistors P1~P6 have identical electrical property.

Therefore, the positive temperature coefficient circuit unit 10 uses the drain terminal of the third transistor P3 to provide the positive temperature coefficient current Iref1 and the negative temperature coefficient circuit unit 20 uses the drain terminal of the sixth transistor P6 to provide the negative temperature coefficient current Iref2 such that the positive and negative temperature coefficient current Iref1 and Iref2 flow through the load unit 30 and the two ends of the load unit 30 generate the reference voltage Vref, which is less influenced by the temperature.

Hereafter, the electrical operation of the low voltage bandgap reference circuit according to the first embodiment of the present invention will be described in detail with reference to FIG. 4. For clear explanation, the load unit 30 is implemented by the resistive load REL.

First, when the first and second differential operational amplifier OP1 and OP2 operate at a steady-state, the first inverting input voltage Va1 is less than the first non-inverting input voltage Vb1, and the second inverting input voltage Va2 is less than the second non-inverting input voltage Vb2. Thus, the current Ia1 flowing through the drain terminal of the first transistor P1, the current Ib1 flowing through the drain terminal of the second transistor P2, the positive temperature coefficient current Iref1 flowing through the drain terminal of the third transistor P3, the current Ia2 flowing through the drain terminal of the fourth transistor P4, the current Ib2 flowing through the drain terminal of the fifth transistor P5, and the negative temperature coefficient current Iref2 flowing through the drain terminal of the sixth transistor P6 are the same in magnitude.

The reference voltage Vref can be expressed by the following equations (13) and (14):

$$\begin{aligned} dVf &= Vf1 - Vf2 \\ &= V_T \cdot In\left(\frac{N \cdot Ia1}{Ib2}\right) \\ &= V_T \cdot In(N), \end{aligned} \tag{13}$$

and

-continued $$Vref = RL\cdot(Iref1 + Iref2) = RL\cdot\left(\frac{Vf1}{R2} + \frac{dVf}{R1}\right) = \frac{RL}{R_2}\cdot\left[Vf1 + \left(\frac{R2}{R1}\right)\cdot dVf)\right]. \quad (14)$$

The equation (15) is further derived by combining equations (4) and (5):

$$\left[Vf1 + \left(\frac{R2}{R1}\right)\cdot dV_f)\right] = 1.27. \quad (15)$$

Finally, the reference voltage Vref shown in equation (16) is acquired by combining equations (14) and (15):

$$Vref = \frac{RL}{R2}\times 1.27. \quad (16)$$

It is apparently from equation (16) that the reference voltage Vref can be adjusted by changing the resistive load RL and the second resistor R2. That is, the reference voltage Vref is independent of the absolute values of the resistive load RL and the second resistor R2. More particularly, for the present semiconductor processes, the ratio of the resistance values of the two resistors can be easily controlled to a considerable small value with high precision. Therefore, the precision of the reference voltage Vref is greatly improved.

Figure 5:
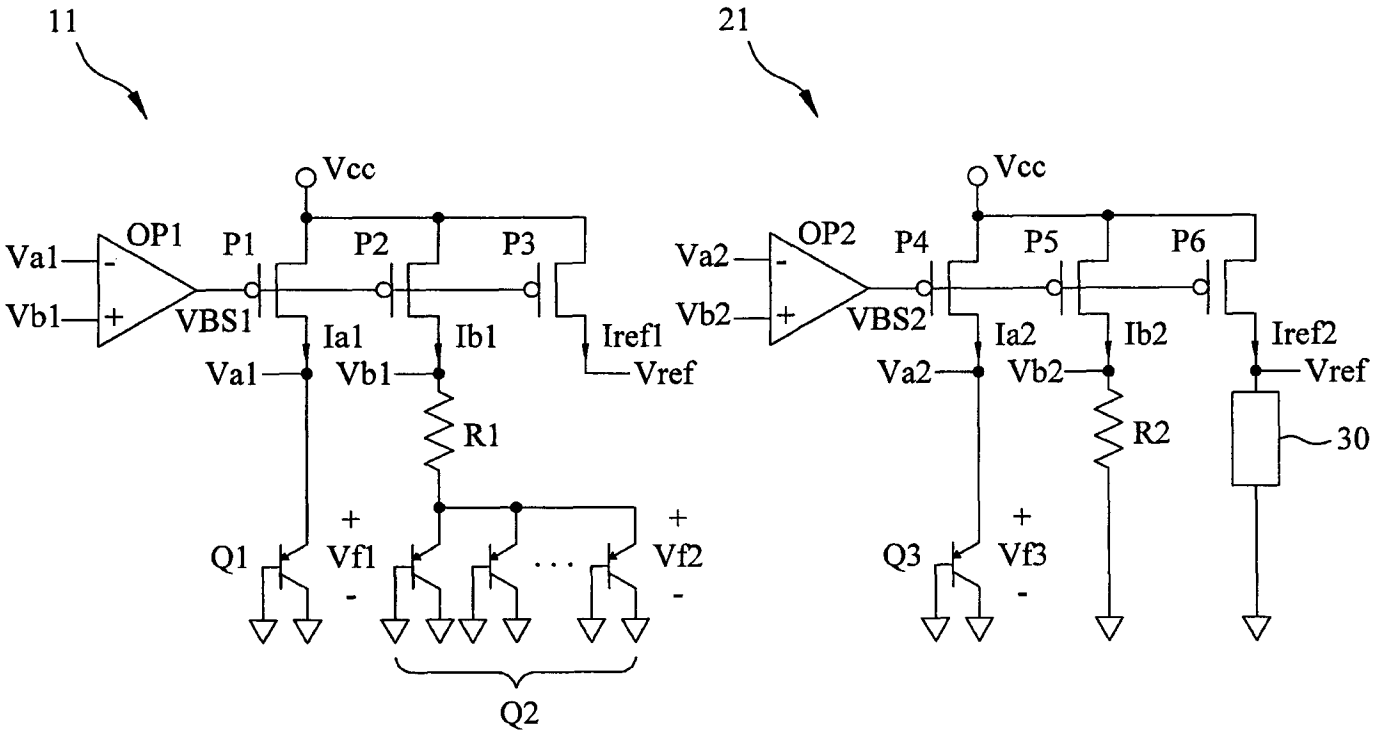
FIG. 5 shows the second embodiment of the low voltage bandgap reference circuit according to the present invention.

Please further refer to FIG. 5. The low voltage bandgap reference circuit shown in FIG. 5 according to the second embodiment of the present invention is similar to the first embodiment mentioned in FIG. 4. The low voltage bandgap reference circuit of the second embodiment provides a stable reference voltage Vref at the power source Vcc with a low voltage, and comprises the positive temperature coefficient circuit unit 11, the negative temperature coefficient circuit unit 21 and the load unit 30. The positive temperature coefficient current Iref1 provided by the positive temperature coefficient circuit unit 11 and the negative temperature coefficient current Iref2 provided by the negative temperature coefficient circuit unit 21 are combined and flow through the load unit 30 to generate the reference voltage Vref at the load unit 30, which has the net temperature coefficient of zero or almost zero.

Specifically, the positive temperature coefficient circuit unit 11 comprises the first differential operational amplifier OP1, the first transistor P1, the second transistor P2, the third transistor P3, the first resistor R1, the first bipolar transistor Q1 and the second bipolar transistor Q2 to generate the positive temperature coefficient current Iref1. Similarly, the negative temperature coefficient circuit 21 comprises the second differential operational amplifier OP2, the fourth transistor P4, the fifth transistor P5, the sixth transistor P6, the second resistor R2 and the third bipolar transistor Q3 to generate the negative temperature coefficient current Iref2.

It should be noted that the primary difference between the first and second embodiments is that the positive temperature coefficient circuit unit 11 of the second embodiment uses the first bipolar transistor Q1 and the second bipolar transistor Q2 to replace the first diode D1 and the second diode D2 in the first embodiment, and simultaneously, the negative temperature coefficient circuit 21 uses the third bipolar transistor Q3 to replace the third diode D3 in the first embodiment. Other components are the same, and the detailed description is thus emitted.

It is preferred that the first, second and third bipolar transistors Q1~Q3 are implemented by PNP bipolar transistors, and the third bipolar transistor Q3 is identical to the first bipolar transistor Q1. In particular, the base and collector terminals of the first, second and third bipolar transistors Q1~Q3 are shorted-circuit and grounded. That is, the base-collector junction of the PNP bipolar transistor is used as a diode. Additionally, the electrical operation of the first, second and third bipolar transistors Q1~Q3 is the same as that of the first, second and third diodes D1~D3. Thus, it is omitted hereafter.

It can be seen from equation (16) that the low voltage bandgap reference circuit of the second embodiment generates the reference voltage, which can be increased by a magnifying factor simply by changing the ratio of the resistances of the load unit and the second resistor, thereby acquiring the reference voltage Vref by multiplying the magnifying factor and 1.27V.

Figure 6:
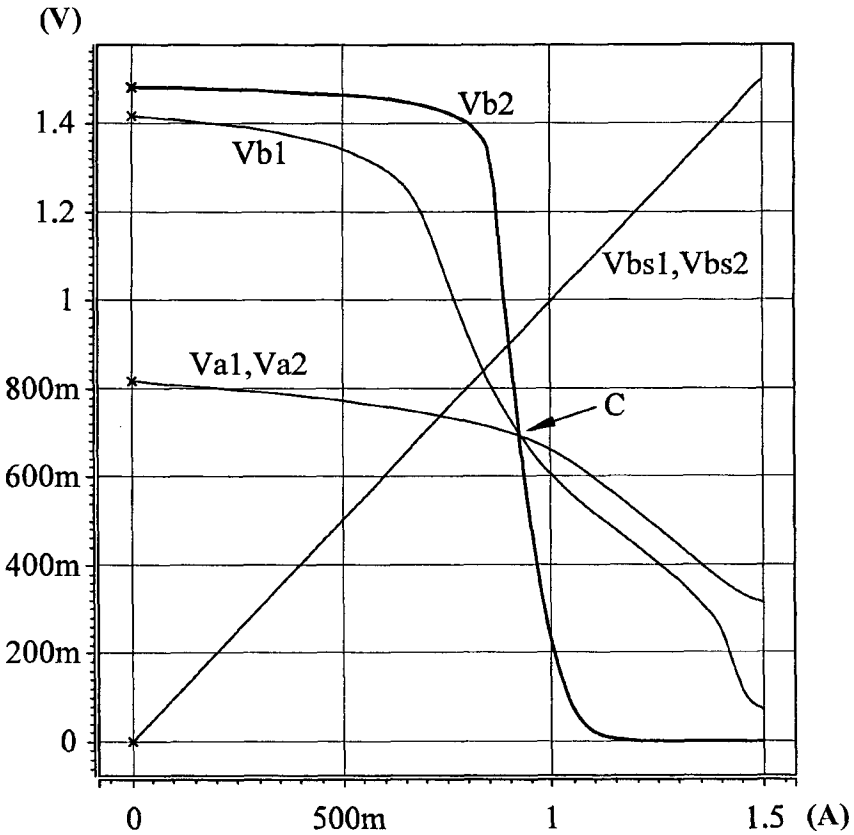
FIG. 6 shows the waveform of the low voltage bandgap reference circuit according to the present invention.

For further description of the key features of the low voltage bandgap of the present invention, please refer to FIG. 6 showing the waveform of the low voltage bandgap reference circuit. It should be noted that the waveform is applicable to the first and second embodiments. As shown in FIG. 6, the low voltage bandgap of the present invention has only one stable operating point C, that is, the point at which the first inverting voltage Va1, the first non-inverting voltage Vb1, the second inverting voltage Va2 and the second non-inverting voltage Vb2 coincide. For example, the stable operating point C is 0.76V, less than 1.27V. Thus, the low voltage bandgap reference circuit of the present invention can normally operate at the power source Vcc less than 1.27V to provide the reference voltage Vref as desired so as to avoid the traditional problem caused by the internal operational amplifier not correctly starting and functioning at low voltage. Therefore, the demand of the low voltage bandgap reference circuit operable at the low voltage power source in modern electric devices is well fulfilled.

Although the present invention has been described with reference to the preferred embodiments, it will be understood that the invention is not limited to the details described thereof Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A low voltage bandgap reference circuit having a single stable operating point to provide a reference voltage, comprising:

a positive temperature coefficient circuit unit for providing a current having a positive temperature coefficient characteristics, comprising a first differential operational amplifier, a first transistor, a second transistor, a third transistor, a first resistor, a first diode and a second diode, wherein source terminals of the first, second and third transistors are connected to a power source, gate terminals of the first, second and third transistors are in parallel connected to an output terminal of the first differential operational amplifier, a drain terminal of the first transistor is connected to a positive end of the first diode, a drain terminal of the second transistor is connected to one end of the first resistor, the other end of the first resistor is connected to a positive end of the second diode, negative ends of the first and second diodes are grounded, the drain terminal of the first transistor is further connected to an inverting input end of the first differential operational amplifier, and the drain terminal of the second transistor is further connected to a non-inverting input end of the first differential operational amplifier;

a negative temperature coefficient circuit for providing a current having a negative temperature coefficient characteristics, comprising a second differential operational amplifier, a fourth transistor, a fifth transistor, a sixth transistor, a second resistor and a third diode, wherein source terminals of the fourth, fifth and sixth transistors are connected to the power source, gate terminals of the fourth, fifth and sixth transistors are in parallel connected to an output terminal of the second differential operational amplifier, a drain terminal of the fourth transistor is connected to a positive end of the third diode, a negative end of the third diode is grounded, a drain terminal of the fifth transistor is connected to one end of the second resistor, the other end of the second resistor is grounded, the drain terminal of the fourth transistor is further connected to an inverting input end of the second differential operational amplifier, and the drain terminal of the fifth transistor is further connected to a non-inverting input end of the second differential operational amplifier; and a load unit, having an end connected to a drain terminal of the third transistor and a drain terminal of the sixth transistor, and another end grounded, wherein the load unit provides the reference voltage across the two ends of the load unit.

2. The low voltage bandgap reference circuit as claimed in claim 1, wherein the second diode is implemented by a plurality of diodes connected in parallel and each electrically identical to the first diode, the third diode has electrical property identical to the first diode, the first differential operational amplifier and the second differential operational amplifier have identical electrical property, each of the first, second, third, fourth, fifth and sixth transistors is implemented by a PMOS (p type metal-oxide semiconductor), and each PMOS has identical electrical property.

3. The low voltage bandgap reference circuit as claimed in claim 1, wherein the load unit is implemented by a resistive load.

4. The low voltage bandgap reference circuit as claimed in claim 1, wherein the stable operation point is less than the power source and/or the reference voltage is less than the power source.

5. The low voltage bandgap reference circuit as claimed in claim 1, wherein the reference voltage is expressed as:

the reference voltage=the resistance of the load unit/
the resistance of the second resistor*1.27 (V).

6. A low voltage bandgap reference circuit having a single stable operating point to provide a reference voltage less than a voltage of a power source, comprising:

a positive temperature coefficient circuit unit for providing a current having a positive temperature coefficient characteristics, comprising a first differential operational amplifier, a first transistor, a second transistor, a third transistor, a first resistor, a first bipolar transistor and a second bipolar transistor, wherein source terminals of the first, second and third transistors are connected to a power source, gate terminals of the first, second and third transistors are in parallel connected to an output terminal of the first differential operational amplifier, a drain terminal of the first transistor is connected to an emitter terminal of the first bipolar transistor, a drain terminal of the second transistor is connected to one end of the first resistor, the other end of the first resistor is connected to an emitter terminal of the second bipolar transistor, base and collector terminals of the first and second bipolar transistors are grounded, the drain terminal of the first transistor is further connected to an inverting input end of the first differential operational amplifier, and the drain terminal of the second transistor is further connected to a non-inverting input end of the first differential operational amplifier;

a negative temperature coefficient circuit for providing a current having a negative temperature coefficient characteristics, comprising a second differential operational amplifier, a fourth transistor, a fifth transistor, a sixth transistor, a second resistor and a third bipolar transistor, wherein source terminals of the fourth, fifth and sixth transistors are connected to the power source, gate terminals of the fourth, fifth and sixth transistors are in parallel connected to an output terminal of the second differential operational amplifier, a drain terminal of the fourth transistor is connected to an emitter terminal of the third bipolar transistor, base and collector terminals of the third bipolar transistor are grounded, a drain terminal of the fifth transistor is connected to one end of the second resistor, the other end of the second resistor is grounded, the drain terminal of the fourth transistor is further connected to an inverting input end of the second differential operational amplifier, and the drain terminal of the fifth transistor is further connected to a non-inverting input end of the second differential operational amplifier; and a load unit, having an end connected to a drain terminal of the third transistor and a drain terminal of the sixth transistor, and another end grounded, wherein the load unit provides the reference voltage across the two ends of the load unit.

7. The low voltage bandgap reference circuit as claimed in claim 6, wherein the second bipolar transistor is implemented by a plurality of bipolar transistors connected in parallel and each having electrical property identical to the first bipolar transistor, the third bipolar transistor has electrical property identical to the first bipolar transistor, the first differential operational amplifier and the second differential operational amplifier have identical electrical property, each of the first, second, third, fourth, fifth and sixth transistors is implemented by a PMOS (p type metal-oxide semiconductor), and each PMOS has identical electrical property.

8. The low voltage bandgap reference circuit as claimed in claim 6, wherein the load unit is implemented by a resistive load.

9. The low voltage bandgap reference circuit as claimed in claim 6, wherein the stable operation point is less than the power source and/or the reference voltage is less than the power source.

10. The low voltage bandgap reference circuit as claimed in claim 6, wherein the reference voltage is expressed as:

the reference voltage=the resistance of the load unit/
the resistance of the second resistor*1.27 (V).

* * * * *